US005913758A

United States Patent [19]

Nunez

[11] Patent Number: 5,913,758

[45] Date of Patent: Jun. 22, 1999

[54] STRETCHING DEVICE

[76] Inventor: Luis Alberto Nunez, Gecko Farms P.O. Box 89 3KM North of Iglesia De Birri Barava, Heredia 3011, Costa Rica

[21] Appl. No.: 09/121,343

[22] Filed: Jul. 23, 1998

[51] Int. Cl.[6] ..... A63B 21/00; A61H 1/00

[52] U.S. Cl. ..... 482/142; 482/140; 601/26; 606/244

[58] Field of Search ..... 482/140, 142, 482/30, 31, 32, 130, 112, 111, 113, 121, 94, 95, 96; 601/24, 25, 26; 606/243, 244, 245, 246

[56] References Cited

U.S. PATENT DOCUMENTS

| | | | |
|---|---|---|---|
| 1,973,945 | 9/1934 | Chavin | 482/130 |
| 2,598,204 | 5/1952 | Allen | 606/244 X |
| 3,674,017 | 7/1972 | Stefani | 601/26 |
| 3,787,049 | 1/1974 | Rellinger . | |
| 4,583,731 | 4/1986 | Crivello | 482/138 |
| 4,723,537 | 2/1988 | Parker | 601/26 |
| 5,044,359 | 9/1991 | Reinert | 606/243 |
| 5,100,131 | 3/1992 | Fong | 482/112 |
| 5,215,511 | 6/1993 | Cheng | 482/121 |
| 5,308,306 | 5/1994 | Wang | 482/142 |
| 5,573,485 | 11/1996 | Geschwender | 482/112 |
| 5,580,340 | 12/1996 | Yu | 482/95 X |
| 5,599,261 | 2/1997 | Easley | 482/130 |
| 5,624,361 | 4/1997 | Lai | 482/130 |
| 5,833,590 | 11/1998 | Chiu | 482/142 |

*Primary Examiner*—Jerome Donnelly
*Assistant Examiner*—William LaMarca

[57] ABSTRACT

A stretching device for stretching and massaging the back of a user. The stretching device includes a base frame and a back rest pivotally coupled to the top of the base frame. The lower end of a support shaft is pivotally coupled to the top of the base frame while the upper end of the support shaft is slidably mounted to the back face of the back rest to permit movement of the upper end of the support shaft between the top and bottom ends of the back rest when the support shaft is pivoted. A pivoting device is provided for pivoting the support shaft to move the upper end of the support shaft between the top and bottom ends of the back rest.

11 Claims, 3 Drawing Sheets

STRETCHING DEVICE

BACKGROUND OF THE INVENTION

1. Field of the Invention

The present invention relates to stretching and exercise devices and more particularly pertains to a new stretching device for stretching and massaging the back of a user.

2. Description of the Prior Art

The use of stretching and exercise devices is known in the prior art. More specifically, stretching and exercise devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art stretching and exercise devices include U.S. Pat. Nos. 4,927,139; 5,416,939; 5,100,131; 4,451,034; 4,583,731; and U.S. Pat. No. Des. 378,933.

While these devices fulfill their respective, particular objectives and requirements, the aforementioned patents do not disclose a new stretching device. The inventive device includes a base frame and a back rest pivotally coupled to the top of the base frame. The lower end of a support shaft is pivotally coupled to the top of the base frame while the upper end of the support shaft is slidably mounted to the back face of the back rest to permit movement of the upper end of the support shaft between the top and bottom ends of the back rest when the support shaft is pivoted. A pivoting device is provided for pivoting the support shaft to move the upper end of the support shaft between the top and bottom ends of the back rest.

In these respects, the stretching device according to the present invention substantially departs from the conventional concepts and designs of the prior art, and in so doing provides an apparatus primarily developed for the purpose of stretching and massaging the back of a user.

SUMMARY OF THE INVENTION

In view of the foregoing disadvantages inherent in the known types of stretching and exercise devices now present in the prior art, the present invention provides a new stretching device construction wherein the same can be utilized for stretching and massaging the back of a user.

The general purpose of the present invention, which will be described subsequently in greater detail, is to provide a new stretching device apparatus and method which has many of the advantages of the stretching and exercise devices mentioned heretofore and many novel features that result in a new stretching device which is not anticipated, rendered obvious, suggested, or even implied by any of the prior art stretching and exercise devices, either alone or in any combination thereof.

To attain this, the present invention generally comprises a base frame and a back rest pivotally coupled to the top of the base frame. The lower end of a support shaft is pivotally coupled to the top of the base frame while the upper end of the support shaft is slidably mounted to the back face of the back rest to permit movement of the upper end of the support shaft between the top and bottom ends of the back rest when the support shaft is pivoted. A pivoting device is provided for pivoting the support shaft to move the upper end of the support shaft between the top and bottom ends of the back rest.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new stretching device apparatus and method which has many of the advantages of the stretching and exercise devices mentioned heretofore and many novel features that result in a new stretching device which is not anticipated, rendered obvious, suggested, or even implied by any of the prior art stretching and exercise devices, either alone or in any combination thereof.

It is another object of the present invention to provide a new stretching device which may be easily and efficiently manufactured and marketed.

It is a further object of the present invention to provide a new stretching device which is of a durable and reliable construction.

An even further object of the present invention is to provide a new stretching device which is susceptible of a low cost of manufacture with regard to both materials and labor, and which accordingly is then susceptible of low prices of sale to the consuming public, thereby making such stretching device economically available to the buying public.

Still yet another object of the present invention is to provide a new stretching device which provides in the apparatuses and methods of the prior art some of the advantages thereof, while simultaneously overcoming some of the disadvantages normally associated therewith.

Still another object of the present invention is to provide a new stretching device for stretching and massaging the back of a user.

Yet another object of the present invention is to provide a new stretching device which includes a base frame and a back rest pivotally coupled to the top of the base frame. The lower end of a support shaft is pivotally coupled to the top of the base frame while the upper end of the support shaft is slidably mounted to the back face of the back rest to permit movement of the upper end of the support shaft between the top and bottom ends of the back rest when the support shaft is pivoted. A pivoting device is provided for pivoting the support shaft to move the upper end of the support shaft between the top and bottom ends of the back rest.

Many people experience pain and discomfort when their back gets out of alignment or their internal organs shift under the pressure of sitting or standing for a prolonged period of time. In many cases, a trip to the chiropractor may be required to relieve the pain. Still yet another object of the present invention is to provide a new stretching device that helps properly align the vertebrae in the user's back and help return the user's muscles and internal organs to their original position and thereby alleviate any back pain the user may have.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
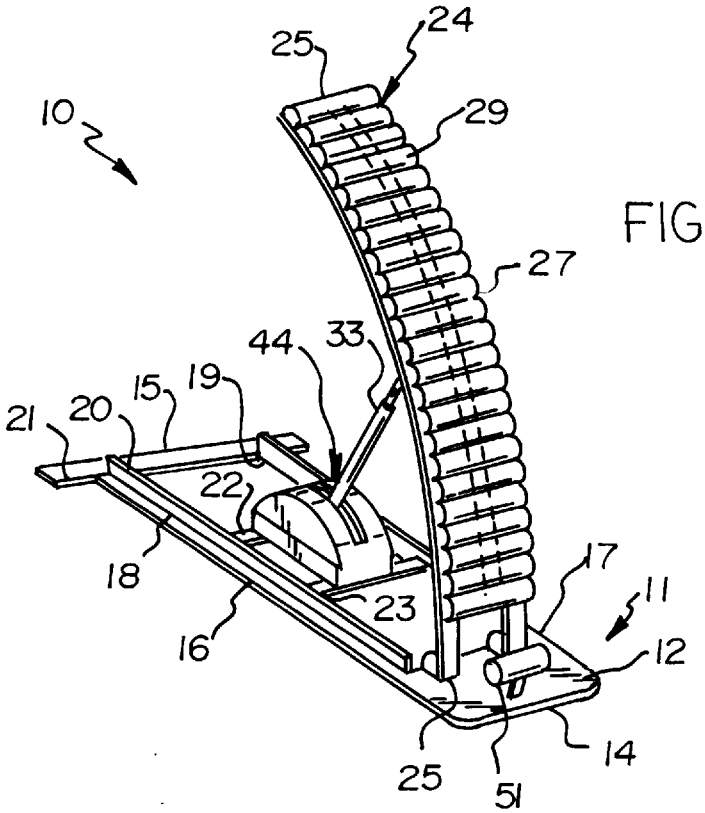
FIG. 1 is a schematic front perspective view of a new stretching device according to the present invention.
Figure 2:
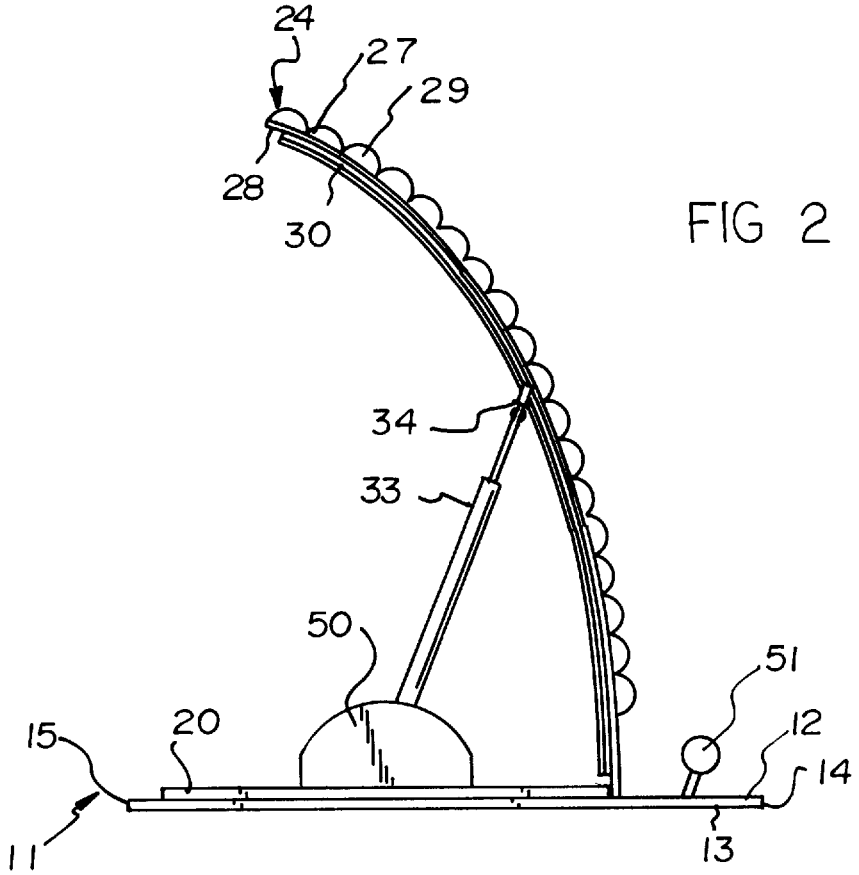
FIG. 2 is a schematic side view of the present invention.
Figure 3:
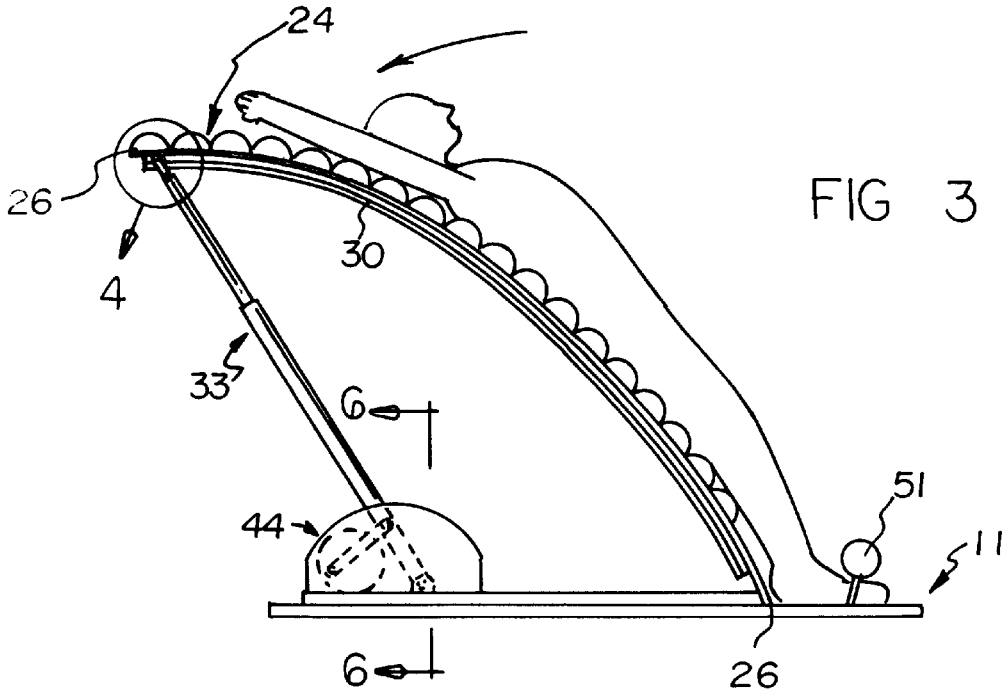
FIG. 3 is a schematic side view of the present invention in use with the back rest in a reclined position.
Figure 4:
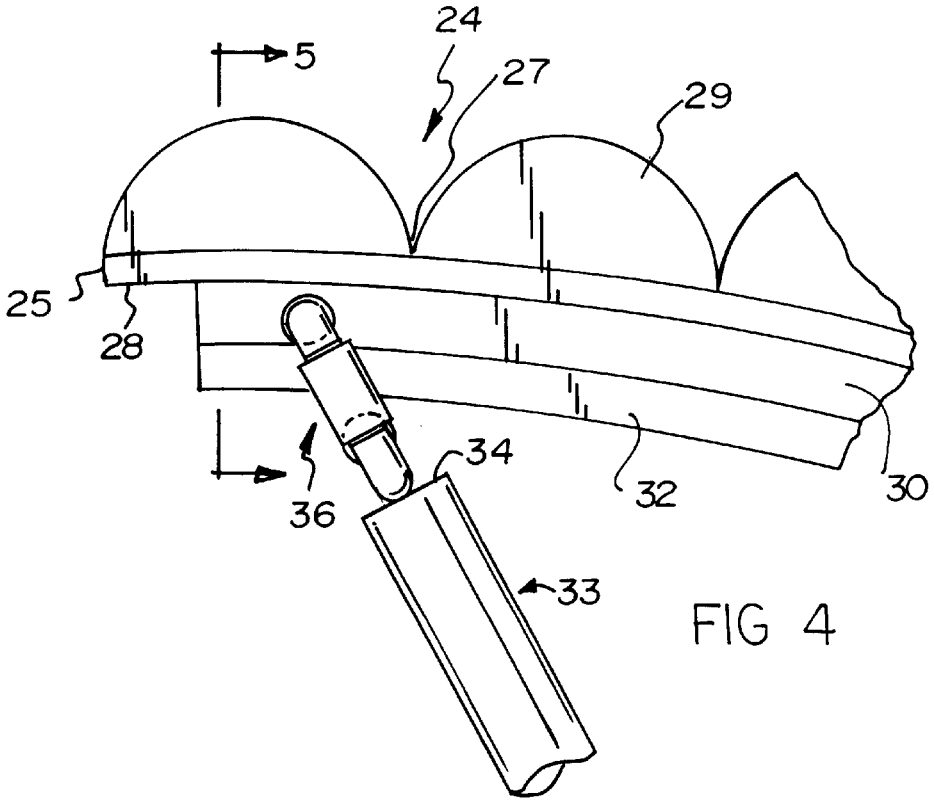
FIG. 4 is a schematic side view of the present invention taken from the vantage of circle 4 on FIG. 3.
Figure 5:
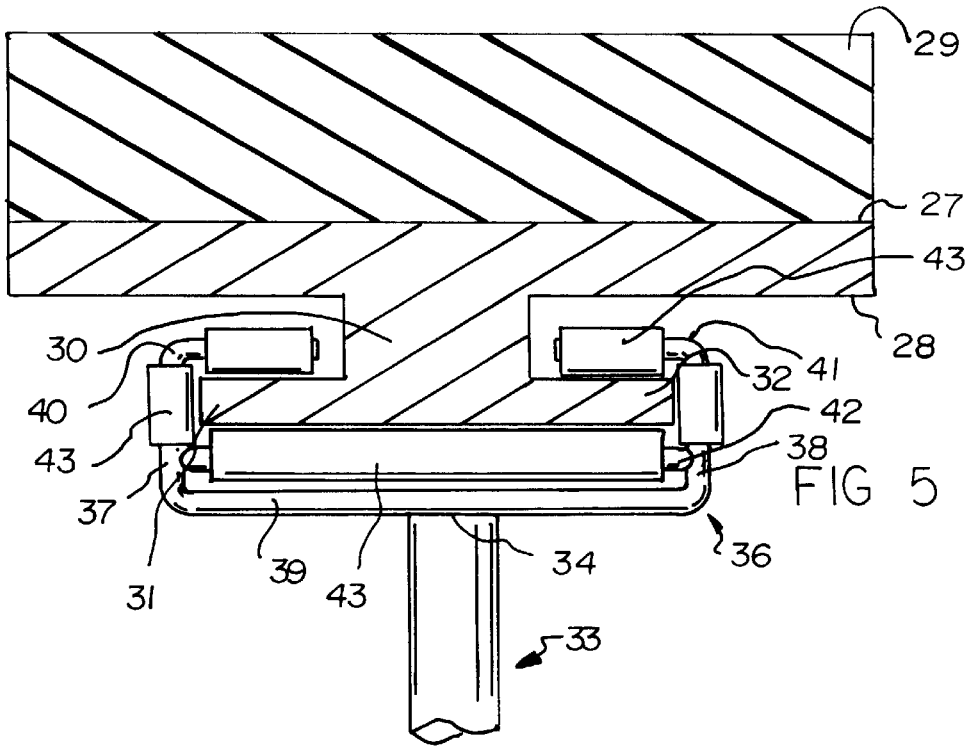
FIG. 5 is a schematic cross sectional view of the present invention taken from line 5—5 of FIG. 4.
Figure 6:
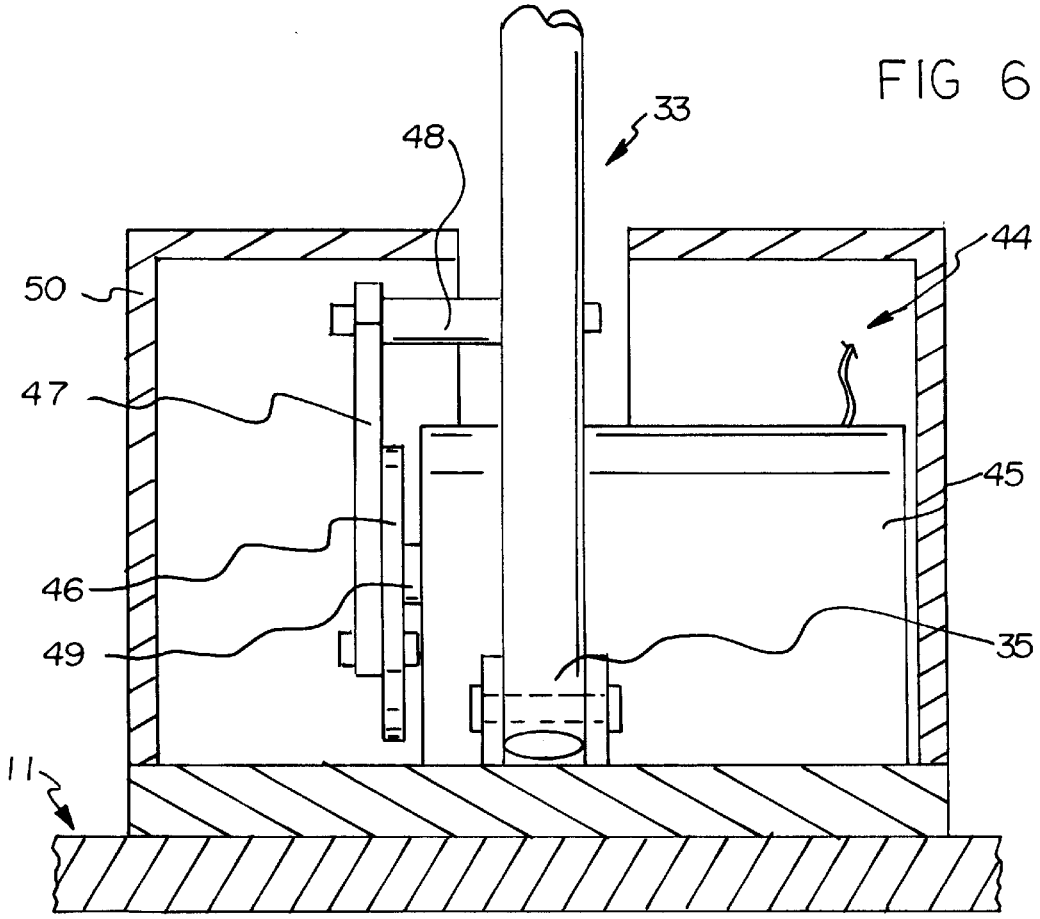
FIG. 6 is a schematic cross sectional view of the present invention taken from line 6—6 of FIG. 3.

With reference now to the drawings, and in particular to FIGS. 1 through 6 thereof, a new stretching device embodying the principles and concepts of the present invention and generally designated by the reference numeral 10 will be described.

The stretching device 10 is designed for stretching and massaging the back of a user to help properly align the vertebrae of the back of the user and help proper align the internal organs in the torso of the user. As best illustrated in FIGS. 1 through 6, the stretching device 10 generally comprises a base frame 11 and a back rest 24 pivotally coupled to the top 12 of the base frame 11. The lower end 35 of a support shaft 33 is pivotally coupled to the top 12 of the base frame 11 while the upper end 34 of the support shaft 33 is slidably mounted to the back face 28 of the back rest 24 to permit movement of the upper end 34 of the support shaft 33 between the top and bottom ends 25,26 of the back rest 24 when the support shaft 33 is pivoted. A pivoting device 44 is provided for pivoting the support shaft 33 to move the upper end 34 of the support shaft 33 between the top and bottom ends 25,26 of the back rest 24.

In closer detail, the base frame 11 has a top 12, a bottom 13, a front 14, a back 15, and a pair of sides 16,17 extending between the front and back 14,15 of the base frame 11. The base frame 11 preferably has a pair of spaced apart base rails 18,19 extending between the front and back 14,15 of the base frame 11 with one of the base rails positioned adjacent one of the sides of the base frame and the other base rail positioned adjacent the other side of the base frame. The length of each of the base rails 18,19 is defined between the front and back 14,15 of the base frame 11. Preferably, each of the base rails 18,19 has an elongate reinforcing portion 20 upwardly extending from the top 12 of the base frame 11 along the length of the associated base rail such that each of the base rails 18,19 has a generally L-shaped cross section taken generally perpendicular to the length of the base rail. The base frame 11 also preferably has an elongate back rail 21 for providing additional stability to the base frame. The back rail 21 is positioned adjacent the back 15 of the base frame 11. The back rail 21 has a longitudinal axis extending generally perpendicular to the sides of the base rail such that the ends of the back rail 21 extend from either side of the base frame 11. Ideally, the base frame 11 has a pair of spaced apart cross bars 22,23 extending between the base rails 18,19 of the base frame 11. The cross bars 22,23 of the base frame 11 are positioned between the front and back 14,15 of the base frame 11.

The back rest 24 is generally arcuate and has opposite top and bottom ends 25,26, and front and back faces 27,28. The bottom end 26 of the back rest 24 is pivotally coupled to the top 12 of the base frame 11 and is positioned towards the front 14 of the base frame 11 with the front face 27 of the back rest 24 facing in a direction towards the front 14 of the base frame 11 and the back face 28 of the back rest 24 facing in a direction towards the back 15 of the base frame 11. Preferably, the front face 27 of the back rest 24 has a row of cushion ribs 29 extending from the front face 27 of the back rest 24. The row of cushion ribs 29 has a length extending between the top and bottom ends 25,26 of the back rest 24. Preferably, each of the cushion ribs 29 has a generally semi-circular cross section taken along a line extending along the length of the back rest 24.

The back face 28 of the back rest 24 has an elongate guide rail 30 extending therefrom. The guide rail 30 has a length extending between the top and bottom ends 25,26 of the back rest 24. The guide rail 30 has a pair of opposite side flanges 31,32 extending therefrom which are spaced apart from the back face 28 of the back rest 24 such that the guide rail 30 has a generally T-shaped cross section taken generally perpendicular to the length of the guide rail 30. Each of the side flanges 31,32 defines an elongate guide channel between the side flange and the back face 28 of the back rest 24. The guide channels each have a length extending between the top and bottom ends 25,26 of the back rest 24. The elongate support shaft 33 has opposite upper and lower ends 34,35, and a longitudinal axis extending between the upper and lower ends 34,35 of the support shaft 33. The lower end 35 of the support shaft 33 is pivotally coupled to the top 12 of the base frame 11. The lower end 35 of the support shaft 33 is positioned between the back 15 of the base frame 11 and the bottom end 26 of the back rest 24.

The upper end 34 of the support shaft 33 has a generally U-shaped guide member 36. The guide member 36 has a pair of spaced apart arm portions 37,38 and a cross portion 39 connecting the arm portions 37,38 together. The cross portion 39 of the guide member 36 is coupled to the upper end 34 of the support shaft 33. Each of the arm portions 37,38 of the guide member 36 has an inwardly extending extent 40,41 that face towards each other. The guide member 36 also has a secondary cross rod 42 extending between the arm portions 37,38 and positioned between the extents 40,41 of the arm portions 37,38 and the cross portion 39 of the guide member 36.

The guide rail 30 is extended between the arm portions 37,38 of the guide member 36 such that one of the side flanges is positioned adjacent one of the arm portions and another of the side flanges is positioned adjacent another of the arm portions. The extents 40,41 of the arm portions 37,38 are extended into the guide channel of the associated side flange and the secondary cross rod 42 is positioned adjacent the guide rail 30. In use, pivoting of the support shaft 33 moves the portions of the guide member 36 along the guide rail 30 between the top and bottom ends 25,26 of the back rest 24. Preferably, the arm portions 37,38, the extents 40,41 and the secondary cross rod 42 each have a generally cylindrical roller 43 disposed therearound. These rollers 43 are rotatable to aid movement of their respective portions of the guide member 36 along the guide rail 30.

In use, the back rest 24 reclines towards a generally horizontal position when the guide member 36 is moved towards the top end 25 of the back rest 24 when the support arm is pivoted towards the back of the base. Conversely, the back rest 24 moves towards a generally vertical upright position when the guide member 36 is moved towards the bottom end 26 of the back rest 24 when the support arm is pivoted towards the front of the base. Ideally, the support shaft 33 is adjustably telescopically extendable to permit selective adjustment of the length of the support shaft 33 defined between the ends of the support shaft 33 to control the degree of reclining of the back rest 24 when pivoted by the support shaft 33.

The pivoting device 44 is designed for pivoting the support shaft 33 back and forth in directions between front and back 14,15 of the base frame 11 to move the guide member 36 along the guide rail 30 such that the back rest 24 is pivoted between its upright and reclined positions. Preferably, the pivoting device 44 comprises a motor 45, a disk-shaped crank 46, a connecting rod 47 and a connecting pin 48. The motor 45 is mounted to the top 12 of the base frame 11. The motor 45 has a rotating shaft 49 which rotates when the motor 45 is energized. The center of the crank 46 is coupled to the rotating shaft 49 such that rotation of the shaft rotates the crank 46. The connecting rod 47 has a pair of opposite ends with one of the ends of the connecting rod 47 pivotally coupled to the crank 46 at a point between the center and the outer circumference of the crank 46. The connecting pin 48 is extended from the support shaft 33 adjacent the lower end 35 of the support shaft 33. Preferably, the connecting pin 48 is extended generally perpendicular to the longitudinal axis of the support shaft 33. The other end of the connecting rod 47 is pivotally coupled to the connecting pin 48 such that rotation of the crank 46 by the rotating shaft 49 causes the connecting rod 47 to move back and forth as the crank 46 rotates thereby causing the support rod to pivot back and forth directions between the front and back 14,15 of the base frame 11. Ideally, the lower end 35 of the support shaft 33 and the motor 45, the crank 46, the connecting rod 47, and the connecting pin 48 are all disposed in a housing 50 mounted to the cross bars 22,23 of the base frame 11.

Preferably, a foot restraint 51 is coupled to the top 12 of the base frame 11 between the front face 27 of the back rest 24 and the front 14 of the base frame 11, the foot restraint 51 is adapted for holding in place the feet of a user standing on the top 12 of the base frame 11 adjacent the front face 27 of the back rest 24.

In an ideal illustrative embodiment, the base frame has a length defined between the front and back of the base frame of about 6 feet, a width defined between the sides of the base frame of about 2 feet. In this ideal illustrative embodiment, the back rail of the base frame preferably has a length between the ends of the back rail of about 4 feet. The back rest ideally has a length defined between the top and bottom ends of the back rest of about 7 feet and a width defined between the support rails of the back rest of about 1½ feet. In this ideal illustrative embodiment, each of the cushion ribs preferably has a radius of about 2 inches.

In use, In use, a user stands on the top of the base frame adjacent the front face of the back rest with the back of the user positioned against the front face of the back rest. The user then secures their feet to the base frame with the foot restraint and raises their arms above their head. As the pivoting device reclines the back rest, the user is also reclined to stretch the back of the user and align the internal organs of the user. The pivoting device then slowly returns the back rest to the standing upright position before repeating the movement. After several repetitions the user should feel more relaxed and any back pain should be reduced.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A stretching device, comprising:

a base frame having a top, a front, and a back;

a back rest having opposite top and bottom ends, and front and back faces;

said back face including an elongated guide rail along the length of said back face and wherein said guide rail has a pair of opposite side flanges defining an elongated guide channel;

said bottom end of said back rest being pivotally coupled to said top of said base frame;

an elongated support shaft having opposite upper and lower ends;

said lower end of said support shaft being pivotally coupled to said top of said base frame, said lower end of said support shaft being positioned between said back of said base frame and said bottom end of said back rest;

said upper end of said support shaft comprising a guide member configured for operative slidable engagement with said guide rail channel to permit movement of said upper end of said support shaft between said top and bottom ends of said back rest when said support shaft is pivoted; and a pivoting device for pivoting said support shaft to move said upper end of said support shaft between said top and bottom ends of said back rest.

2. The stretching device of claim 1, wherein said base frame has a pair of sides extending between said front and back of said base frame, wherein said base frame has a pair of spaced apart base rails extending between said front and back of said base frame, one of said base rails being positioned adjacent one of said sides of said base frame, another of said base rails being positioned adjacent another of said sides of said base frame, and wherein said base frame has an elongate back rail positioned adjacent said back of said base frame, said back rail having a pair of opposite ends, said back rail having a longitudinal axis extending generally perpendicular to said sides of said base rail such that said ends of said back rail extend from either side of said base frame.

3. The stretching device of claim 2, wherein each of said base rails has a length defined between said front and back of said base frame, and wherein each of said base rails has an elongate reinforcing portion upwardly extending from said top of said base frame along the length of the associated base rail such that each of said base rails has a generally L-shaped cross section taken generally perpendicular to said length of said base rail.

4. The stretching device of claim 1, wherein said front face of said back rest has a row of cushion ribs extending from said front face of said back rest, said row of cushion ribs having a length extending between said top and bottom ends of said back rest, each of said cushion ribs having a generally semi-circular cross section taken along a line extending along said length of said back rest.

5. The stretching device of claim 1, wherein said back face of said back rest has an elongate guide rail extending therefrom, said guide rail having a length extending between said top and bottom ends of said back rest, wherein said guide rail has a pair of opposite side flanges extending therefrom, said side flanges being spaced apart from said back face of said back rest such that said guide rail has a generally T-shaped cross section taken generally perpendicular to said length of said guide rail, and wherein each of said side flanges defines an elongate guide channel between said side flange and said back face of said back rest, said guide channels each having a length extending between said top and bottom ends of said back rest.

6. The stretching device of claim 5, wherein said upper end of said support shaft has a generally U-shaped guide member, said guide member having a pair of spaced apart arm portions and a cross portion connecting said arm portions together, said cross portion of said guide member being coupled to said upper end of said support shaft, each of said arm portions of said guide member having an extent, said extents of said arm portions facing towards each other, wherein said guide member has a secondary cross rod extending between said arm portions, said secondary cross rod being positioned between said extents of said arm portions and said cross portion of said guide member, and wherein said guide rail is extended between said arm portions of said guide member such that one of said side flanges is positioned adjacent one of said arm portions and another of said side flanges is positioned adjacent another of said arm portions, said extents of said arm portions being extended into the guide channel of the associated side flange, said secondary cross rod being positioned adjacent said guide rail.

7. The stretching device of claim 6, wherein said arm portions, said extents and said secondary cross rod each have a generally cylindrical roller disposed therearound, said rollers being rotatable to aid movement of said portions of said guide member along said guide rail.

8. The stretching device of claim 1, wherein said support shaft is adjustably telescopically extendable.

9. The stretching device of claim 1, wherein said pivoting device comprises a motor, a crank, a connecting rod and a connecting pin, said motor being mounted to said top of said base frame, said motor having a rotating shaft, said crank being coupled to said rotating shaft such that rotation of said shaft rotates said crank, said connecting rod having a pair of opposite ends, one of said ends of said connecting rod being pivotally coupled to said crank, said connecting pin being extended from said support shaft adjacent said lower end of said support shaft, said connecting pin being extended generally perpendicular to said longitudinal axis of said support shaft, another of said ends of said connecting rod being pivotally coupled to said connecting pin.

10. The stretching device of claim 1, further comprising a foot restraint being coupled to said top of said base frame between said front face of said back rest and said front of said base frame, said foot restraint being adapted for holding in place the feet of a user standing on said top of said base frame adjacent said front face of said back rest.

11. An stretching device, comprising:

a base frame having a top, a bottom, a front, a back, and a pair of sides extending between said front and back of said base frame;

said base frame having a pair of spaced apart base rails extending between said front and back of said base frame, one of said base rails being positioned adjacent one of said sides of said base frame, another of said base rails being positioned adjacent another of said sides of said base frame;

each of said base rails having a length defined between said front and back of said base frame, each of said base rails having an elongate reinforcing portion upwardly extending from said top of said base frame along the length of the associated base rail such that each of said base rails has a generally L-shaped cross section taken generally perpendicular to said length of said base rail;

said base frame having an elongate back rail positioned adjacent said back of said base frame, said back rail having a pair of opposite ends, said back rail having a longitudinal axis extending generally perpendicular to said sides of said base rail such that said ends of said back rail extend from either side of said base frame;

said base frame having a pair of spaced apart cross bars extending between said base rails of said base frame, said cross bars of said base frame being positioned between said front and back of said base frame;

a back rest being generally arcuate and having opposite top and bottom ends, and front and back faces;

said bottom end of said back rest being pivotally coupled to said top of said base frame, said bottom end of said back rest being positioned towards said front of said base frame, said front face of said back rest facing in a direction towards said front of said base frame, said back face of said back rest facing in a direction towards said back of said base frame;

said front face of said back rest having a row of cushion ribs extending from said front face of said back rest, said row of cushion ribs having a length extending between said top and bottom ends of said back rest, each of said cushion ribs having a generally semi-circular cross section taken along a line extending along said length of said back rest;

said back face of said back rest having an elongate guide rail extending therefrom, said guide rail having a length extending between said top and bottom ends of said back rest;

said guide rail having a pair of opposite side flanges extending therefrom, said side flanges being spaced apart from said back face of said back rest such that said guide rail has a generally T-shaped cross section taken generally perpendicular to said length of said guide rail;

each of said side flanges defining an elongate guide channel between said side flange and said back face of said back rest, said guide channels each having a length extending between said top and bottom ends of said back rest;

an elongate support shaft having opposite upper and lower ends, and a longitudinal axis extending between said upper and lower ends of said support shaft;

said lower end of said support shaft being pivotally coupled to said top of said base frame, said lower end of said support shaft being positioned between said back of said base frame and said bottom end of said back rest;

said upper end of said support shaft having a generally U-shaped guide member, said guide member having a pair of spaced apart arm portions and a cross portion connecting said arm portions together, said cross portion of said guide member being coupled to said upper end of said support shaft;

each of said arm portions of said guide member having a extent, said extents of said arm portions facing towards each other;

said guide member having a secondary cross rod extending between said arm portions, said secondary cross rod being positioned between said extents of said arm portions and said cross portion of said guide member;

said guide rail being extended between said arm portions of said guide member such that one of said side flanges is positioned adjacent one of said arm portions and another of said side flanges is positioned adjacent another of said arm portions, said extents of said arm portions being extended into the guide channel of the associated side flange, said secondary cross rod being positioned adjacent said guide rail;

wherein pivoting of said support shaft moves said portions of said guide member along said guide rail between said top and bottom ends of said back rest;

said arm portions, said extents and said secondary cross rod each having a generally cylindrical roller disposed therearound, said rollers being rotatable to aid movement of said portions of said guide member along said guide rail;

wherein said back rest reclines towards a generally horizontal position when said guide member is moved towards said top end of said back rest when said support arm is pivoted towards said back of said base;

wherein said back rest moves towards a generally vertical upright position when said guide member is moved towards said bottom end of said back rest when said support arm is pivoted towards said front of said base;

wherein said support shaft is adjustably telescopically extendable;

a pivoting device for pivoting said support shaft to move said guide member along said guide rail;

said pivoting device comprising a motor, a crank, a connecting rod and a connecting pin;

said motor being mounted to said top of said base frame, said motor having a rotating shaft;

said crank being coupled to said rotating shaft such that rotation of said shaft rotates said crank;

said connecting rod having a pair of opposite ends, one of said ends of said connecting rod being pivotally coupled to said crank;

said connecting pin being extended from said support shaft adjacent said lower end of said support shaft, said connecting pin being extended generally perpendicular to said longitudinal axis of said support shaft;

another of said ends of said connecting rod being pivotally coupled to said connecting pin; and a foot restraint being coupled to said top of said base frame between said front face of said back rest and said front of said base frame, said foot restraint being adapted for holding in place the feet of a user standing on said top of said base frame adjacent said front face of said back rest.

* * * * *